US006874476B2

(12) United States Patent
Brenk et al.

(10) Patent No.: US 6,874,476 B2
(45) Date of Patent: Apr. 5, 2005

(54) 3/2-WAY VALVE

(75) Inventors: Achim Brenk, Kaempfelbach-Bilfingen (DE); Wolfgang Klenk, Loechgau (DE); Uwe Gordon, Kemmern (DE); Manfred Mack, Altheim (DE)

(73) Assignee: Robert Bosch GmbH, Stuttgart (DE)

( * ) Notice: Subject to any disclaimer, the term of this patent is extended or adjusted under 35 U.S.C. 154(b) by 43 days.

(21) Appl. No.: 10/276,687

(22) PCT Filed: Mar. 15, 2002

(86) PCT No.: PCT/DE02/00955

§ 371 (c)(1),
(2), (4) Date: Jul. 2, 2003

(87) PCT Pub. No.: WO02/075150

PCT Pub. Date: Sep. 26, 2002

(65) Prior Publication Data

US 2004/0134466 A1 Jul. 15, 2004

(30) Foreign Application Priority Data

Mar. 17, 2001 (DE) ..... 101 13 028

(51) Int. Cl.[7] ..... F02M 37/04
(52) U.S. Cl. ..... 123/467; 123/447

(58) Field of Search ..... 123/446, 447, 123/467, 456, 510–511, 514, 458

(56) References Cited

U.S. PATENT DOCUMENTS

| | | | | | |
|---|---|---|---|---|---|
| 4,211,202 | A | * | 7/1980 | Hafner | 123/457 |
| 5,526,791 | A | * | 6/1996 | Timmer et al. | 123/467 |
| 5,651,346 | A | * | 7/1997 | Remmels et al. | 123/447 |
| 5,979,410 | A | * | 11/1999 | Grieshaber | 123/467 |
| 6,067,955 | A | * | 5/2000 | Boecking | 123/299 |
| 6,129,332 | A | * | 10/2000 | Dusterhoft | 251/28 |

* cited by examiner

*Primary Examiner*—Thomas Moulis
(74) *Attorney, Agent, or Firm*—Ronald E. Greigg

(57) ABSTRACT

The invention relates to a 3/2-way valve for controlling the injection of fuel in a common rail injection system of an internal combustion engine, having a first switching position, in which an injection nozzle is in communication with a fuel return, and a second switching position, in which the injection nozzle is in communication with a common rail. To improve the function and quality of the injection, the 3/2-way valve includes two force-balanced control pistons, which are guided separately from one another, and on each of which a respective valve seat edge is embodied.

19 Claims, 4 Drawing Sheets

3/2-WAY VALVE

CROSS-REFERENCE TO RELATED APPLICATIONS

This application is a 35 USC 371 application of PCT/DE 02/00955 filed on Mar. 15, 2002.

BACKGROUND OF THE INVENTION

1. Field of the Invention

The invention relates to a 3/2-way valve for controlling the injection of fuel in a common rail injection system of an internal combustion engine, having a control member guided in a housing, wherein the control member in a first switching position opens a hydraulic communication between an injector and a fuel return, and in a second switching position the control member opens a hydraulic communication between the injector and a common rail.

2. Description of the Prior Art

One 3/2-way valve of the above type is known for instance from German Patent Disclosure DE 197 24 637 A1. In common rail injection systems, a high-pressure fuel pump pumps the fuel into the central high-pressure reservoir, which is called a common rail. From the rail, high-pressure lines lead to the individual injectors, which are assigned one to each of the engine cylinders. The injectors are triggered individually by the engine electronics. When the control valve opens, fuel subjected to high pressure moves past the nozzle needle, which is lifted counter to the prestressing force of a nozzle spring, to reach the combustion chamber.

The object of the invention is to improve the function and quality of the injection. Moreover, the control valve of the invention should be simple in construction and it should be possible to produce it economically.

In a 3/2-way valve for controlling the injection of fuel in a common rail injection system of an internal combustion engine, having a control member guided in a housing, wherein the control member in a first switching position opens a hydraulic communication between an injector and a fuel return, and in a second switching position the control member opens a hydraulic communication between the injector and a common rail, this object is attained in that the control member includes a first control piston and a second control piston; that between the housing and the first control piston a first valve seat is embodied; and that between the housing and the second control piston, a second valve seat is embodied.

SUMMARY OF THE INVENTION

Because of the structural embodiment as a seat/seat valve, the metering and diversion cross sections to be controlled can be designed freely within wide limits, so that with the 3/2-way metering valve of the invention, fast control times can be achieved. Moreover, the functional safety and reliability is enhanced by the use of two control pistons. Further, using two control pistons also simplifies the production of the metering valve of the invention, since the guides for two control pistons can be disposed on either one and the same axis or on different axes. The guidance of the control pistons can be achieved by a guide bore in the valve housing, and the guide bore can also be embodied as a stepped bore.

In an advantageous variant of the invention, it is provided that one face end of the first control piston defines a control chamber; that the control chamber is in hydraulic communication with the fuel inlet via an inlet throttle; and that the control chamber can be made to communicate hydraulically with an outlet via an outlet throttle, so that at least in part, construction elements known per se and having stood the test of time can be made use of in achieving the metering valve of the invention.

In a further feature of the invention, the hydraulic communication between the control chamber and the outlet is controlled by a magnet valve or a piezoelectric actuator, so that the specific advantages thereof can also be utilized in the metering valve of the invention.

To save installation space and simplify manufacture, the inlet throttle can be integrated with the first control piston. However, then one additional communication with the common rail must be provided in the valve housing of the 3/2-way valve.

In a further feature of the invention, one face end of the second control piston defines a pressure chamber; and that in the pressure chamber, the pressure of the common rail prevails, so that the second control piston is always pressed in the direction of the first control piston. Also in this version, the second control piston is at least partly pressure-balanced. Alternatively, the second control piston can also be pressed in the direction of the first control piston by a compression spring.

In especially advantageous variants of the invention, it is provided that the first control piston is guided in a guide bore; that the connection discharges into the guide bore; and that the first control piston has a first plunge cut in the region of the orifice of the connection, and/or that the second control piston is guided in a guide bore; that the connection discharges into the guide bore; and that the second control piston has a second plunge cut in the region of the orifice of the connection, so that an at least partial force balance of the first and/or second control piston is brought about. This decreases the actuation forces of the control pistons considerably, which shortens the control times and lengthens the service life of the metering valve. The guide bore can also be embodied as a stepped bore.

The metering valve of the invention can also be used in other pressure-controlled fuel injection systems. The protection sought with the present patent application is intended to cover these uses as well.

BRIEF DESCRIPTION OF THE DRAWINGS

Further advantages, characteristics and details of the invention will become apparent from the ensuing description, in which various exemplary embodiments of the invention are described in detail in conjunction with the drawings, in which.

DESCRIPTION OF THE PREFERRED EMBODIMENTS

Figure 1:
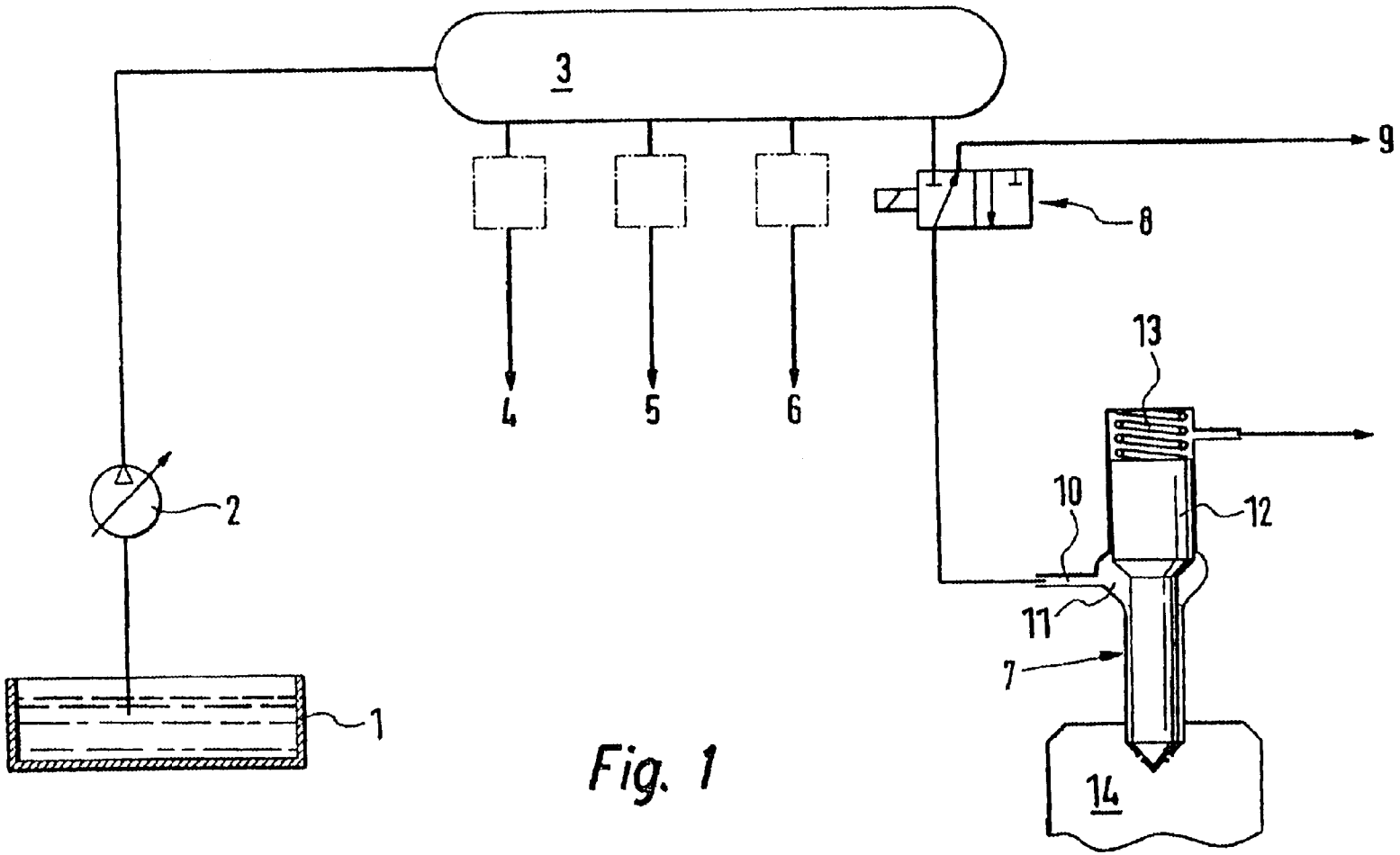
FIG. 1 is a schematic view of a common rail injection system.

In FIG. 1, a common rail injection system is shown schematically. From a fuel tank 1, fuel is pumped with the aid of a pump unit 2 into a common rail 3 and subjected to high pressure. The fuel subjected to high pressure is then allocated as needed to the various cylinders of the internal combustion engine to be supplied. The injection of the fuel that is subjected to high pressure takes place through injectors 4, 5, 6 and 7.

In FIG. 1, for the sake of simplicity, only the injector 7 is shown. The supply of fuel to the injector 7 is effected via a metering valve 8. The metering valve 8 can be designed, regardless of the embodiment selected, as an independent component group. This makes it possible to mount the valve arbitrarily between the common rail and a nozzle holder, so that there is a free choice of line lengths between the common rail and the metering valve and between the metering valve and the nozzle holder.

The metering valve 8 is a 3/2-way valve, which is actuated electromagnetically. In the switching position shown in FIG. 1, the communication between the common rail 3 and a high-pressure connection 10 of the injector is interrupted. The high-pressure connection 10 of the injector 7 communicates with a fuel return 9, in the switching position of the metering valve 8 shown in FIG. 1.

Upon an actuation of the metering valve 8, a switchover is made to the second switching position, not shown in FIG. 1. In the second switching position, the high-pressure connection 10 of the injector 7 communicates directly with the common rail 3. In this switching position, fuel subjected to high pressure flows out of the common rail 3 via the high-pressure connection 10 to reach a pressure chamber 11 which is embodied in the injector 7. When the pressure in the pressure chamber 11 exceeds a certain value, a nozzle needle 12 prestressed counter to a nozzle spring 13 lifts from its seat, and fuel subjected to high pressure is injected into the combustion chamber 14 of the engine to be supplied.

Figure 3:
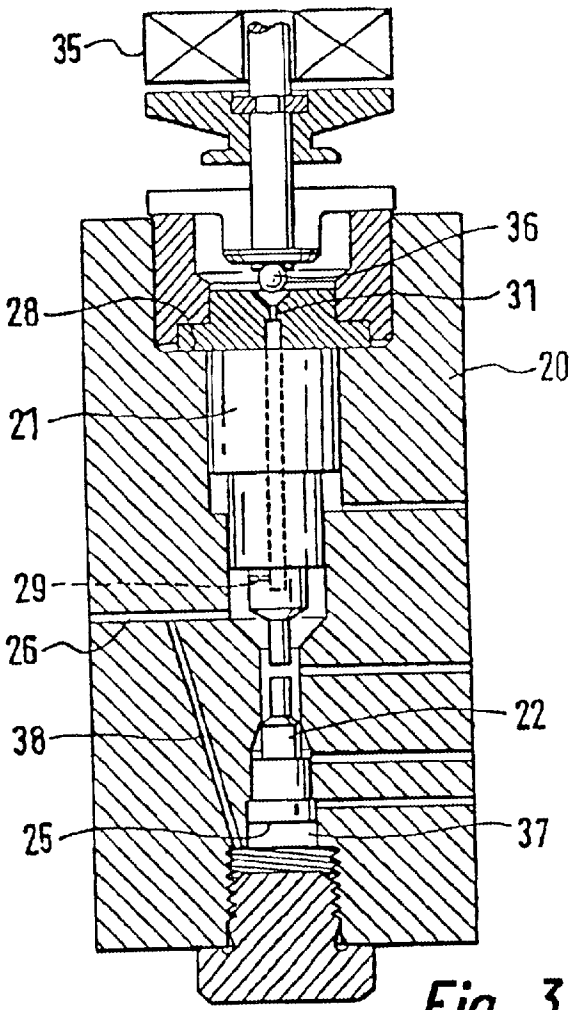
FIG. 3, the 3/2-way valve of FIG. 2, in the second switching position.
Figure 2:
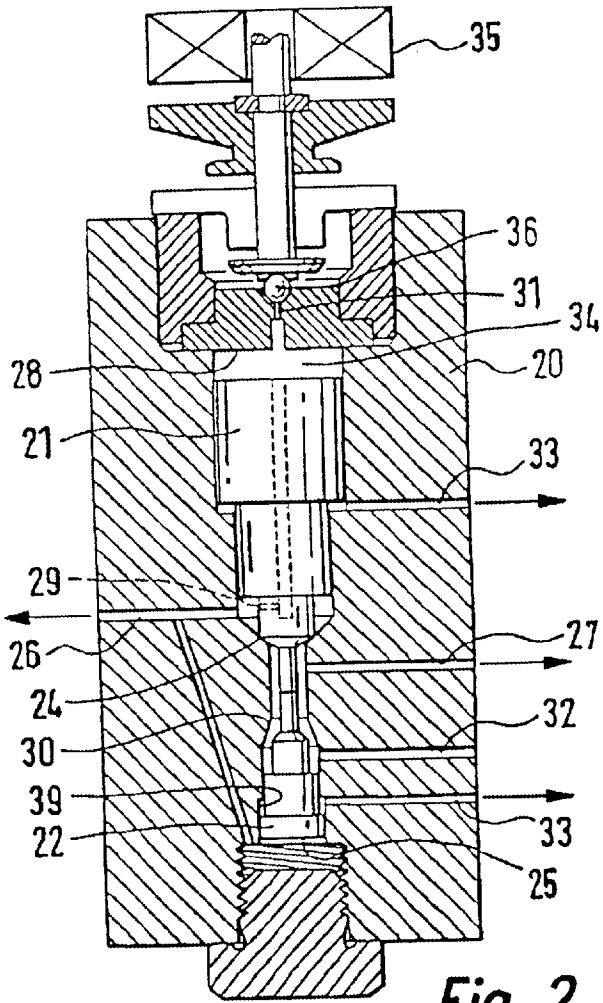
FIG. 2, a first embodiment of a 3/2-way valve of the invention useful in the system according to FIG. 1, with a two-part control pistion, in the first switching pistion.

In FIGS. 2 and 3, a 3/2-way valve embodied as a seat/seat valve is shown. The metering valve, shown in longitudinal section in FIGS. 2 and 3, includes a valve housing 20, in which a first control piston 21 and a second control piston 22 are received in a manner capable of reciprocation.

In the first switching position shown in FIG. 2, a first valve seat 24 embodied between the first control piston 21 and the valve housing 20 is closed. The hydraulic communication between a fuel inlet 26, which in turn communicates with a common rail, not shown, and a connection 27 to an injection nozzle (not shown) or injector is thus interrupted.

A second valve seat 30, which is embodied on the second control piston 22 and the valve housing 20, is shown open in the first switching position. As a result, a hydraulic communication between the connection 27 for the injection nozzle and a first fuel return 32 is opened. A second fuel return 33 serves to return the leak fuel occurring during operation. In this first switching position, the injector (not shown) is pressureless.

The motion of the first and second control pistons 21 and 22 is controlled with the aid of a magnet valve 35, via the pressure in a control chamber 34 above the first control piston 21. In the first switching position shown in FIG. 2, a pressure relief of the control chamber 34 is prevented by a valve ball 36. Via an inlet throttle 29 embodied in the first control piston 21, fuel subjected to high pressure reaches the control chamber 34. The fuel subjected to high pressure that is located in the control chamber 34 assures that the first control piston 21 is pressed against the second control piston 22 and into the first valve seat 24. The second control piston 22 is pressed against the first control piston 21 by a hydraulic force that acts on one face end 25 of the second control piston 22. The hydraulic force is caused by the pressure in a pressure chamber 37. The pressure chamber communicates with the fuel inlet 26 via a bore 38.

When the magnet valve 35 opens and the valve ball 36 lifts from its associated seat, the pressure in the control chamber 34 drops, and the first control piston 21 moves upward as far as a stop 28. The speed of the motion of the first control piston 21 can be adjusted by means of the design of the surfaces subjected to pressure on the first control piston 21 and by the adaptation of an inlet throttle 29 and an outlet throttle 31.

At the same time, the second control piston 22 is likewise moved upward by the above-described hydraulic force, so that the second valve seat 30 is closed.

Because the metering valve 8 of the invention is embodied as a seat/seat valve, the leakage quantities are reduced, the tightness increases, and the controlled flow cross sections are larger than in a slide valve. As a result, the injectors-can be triggered faster and more precisely, which has an advantageous effect on the operating performance of the engine.

The two control pistons 21 and 22 are guided separately. This simplifies the production of the metering valve considerably. Moreover, any error of alignment of the second control piston 22 to the first control piston 21 has no adverse effect on the function of the metering valve 8. The size of the metering and diversion cross section can be made arbitrarily large.

The speeds of motion of the two control pistons 21 and 22 during operation can be varied within wide limits by means of the design of the inlet throttle and outlet throttle 29 and 31.

In the currentless state of the magnet valve 35, the first control piston 21 is held in the first valve seat 24. As a result, the communication with the fuel inlet 26 and thus also with the common rail (not shown) remains closed, and the communication between the fuel return 32 and the connection 27 remains open. In the switching position shown in FIG. 2, no injection takes place.

When current is supplied to the magnet valve 35, the pressure in the control chamber 34 drops, and the pressure forces acting on the control piston 21 lift it out of the first valve seat 24. Simultaneously, the hydraulic force acting on the end face 25 assures lifting of the second control piston 22. The communication between the fuel inlet 26 and the connection 27 is now opened; fuel injection occurs through the injector or the injection nozzle (not shown). At the same time, the communication between the connection 27 and the fuel return 32 is interrupted.

As soon as the current supply to the magnet valve 35 is interrupted, the pressure in the control chamber 34 rises again, and the first control piston 21 is again pressed downward into the first valve seat 24. Simultaneously, as a result of the downward motion of the first control piston 21, the second control piston 22 is also pressed downward, counter to the hydraulic force acting on the end face 25. This interrupts the communication between the fuel inlet 26 and the connection 27. Moreover, the communication between the connection 27 and the first fuel return 32 is opened.

Figure 4:
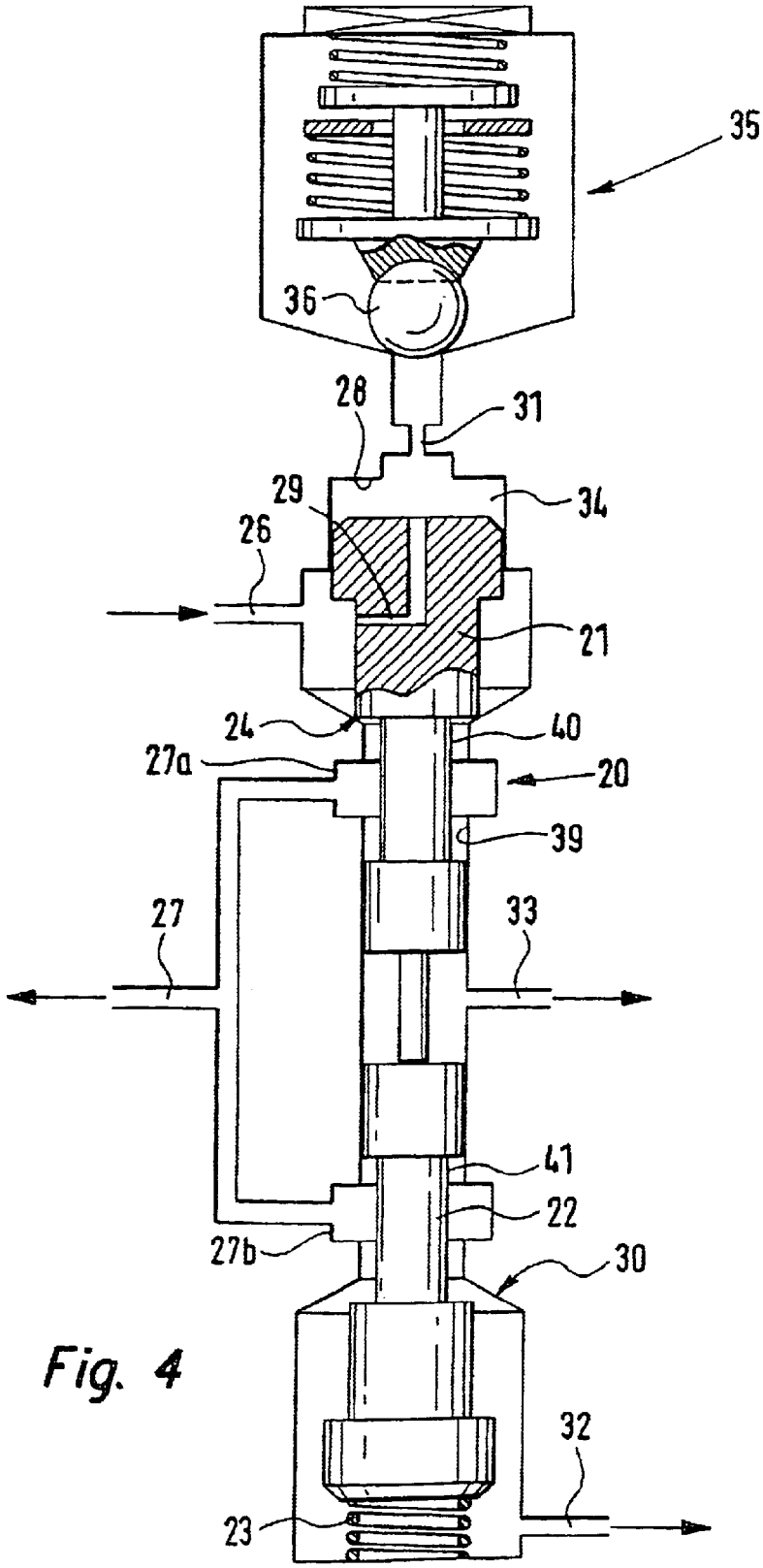
FIG. 4, a second embodiment of a 3/2-way valve of the invention, with a two-part control piston, in the first switching position.
Figure 5:
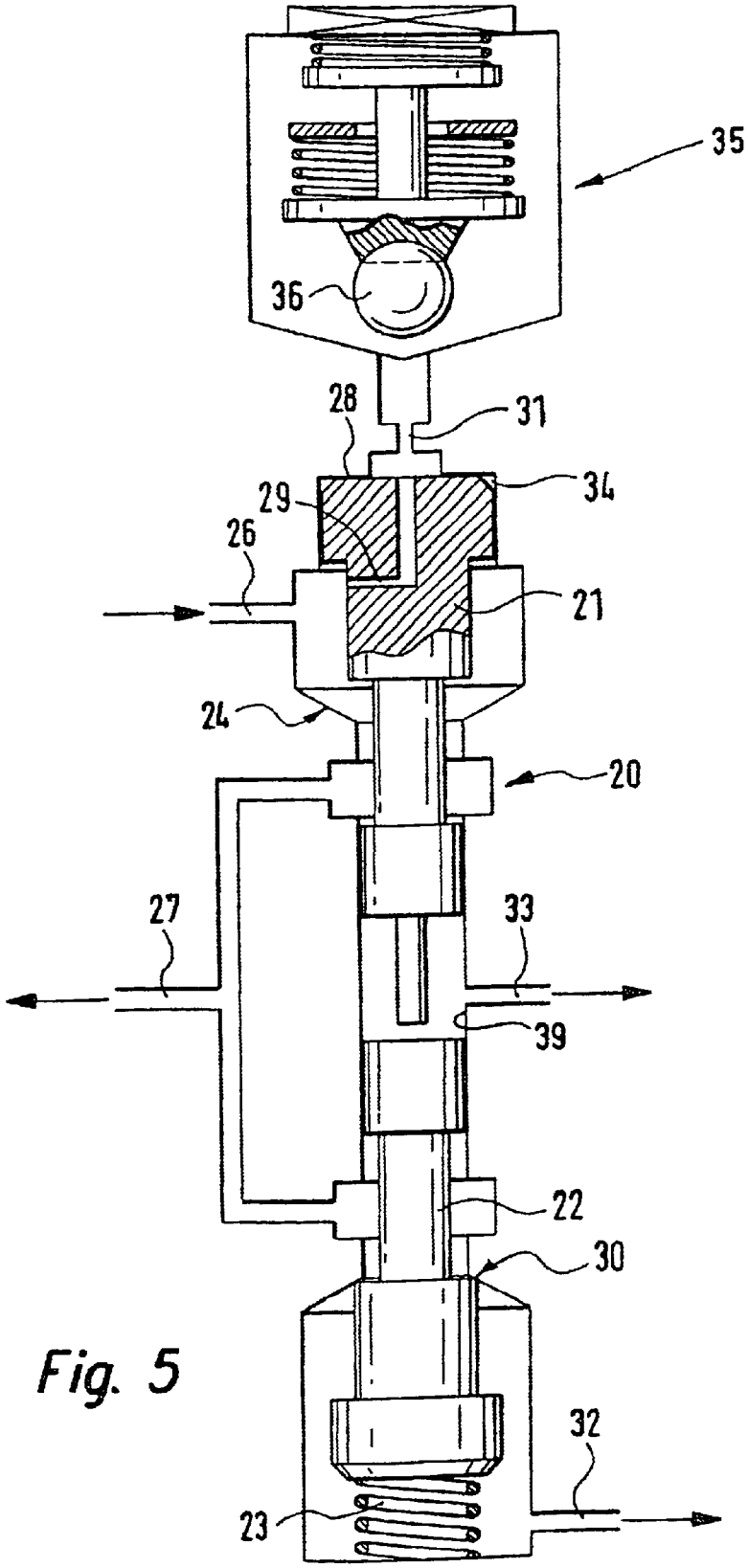
FIG. 5, the 3/2-way valve of FIG. 4, in the second switching position.

In FIGS. 4 and 5, a second exemplary embodiment of a 3/2-way valve, embodied as a seat/seat valve, is shown. The metering valve, shown schematically in longitudinal section in FIGS. 4 and 5, includes a valve housing 20, in which a first control piston 21 and a second control piston 22 are received in a guide bore 39 so as to be capable of reciprocation. Because of the structural design of their pressure faces, the two control pistons 21 and 22 are each separately force-balanced. The force balance of the first control piston 21 is achieved by means of a first plunge cut 40 in the first control piston 21 in the region 27 a of the connection 27. The force balance of the second control piston 22 is achieved by a second plunge cut 41 in the second control piston 22 in the region 27*b* of the connection 27. This means that even the slightest forces are sufficient for a motion of the corresponding control piston.

The second control piston 22 is prestressed by a compression spring 23. In the switching position shown in FIG. 2, the first control piston 21 rests on the end of the second control piston 22 remote from the compression spring 23. On the first control piston 21 and the valve housing 20, a first valve seat 24 is embodied, which is shown closed in FIG. 4.

In the first switching position shown in FIG. 4, a communication between the fuel inlet 26, which in turn communicates with a common rail, not shown, and a connection. 27 and an injection nozzle (not shown) is interrupted.

A second valve seat 30, which is embodied on the second control piston 22 and the valve housing 20, is shown open in FIG. 4. As a result, a communication between the connection 27 for the injection nozzle and a first fuel return 32 is opened. A second fuel return 33 serves to return the leak fuel that occurs during operation. In this first switching position, the injector, not shown, is pressureless.

The motion of the two control pistons 21 and 22 is controlled with the aid of a magnet valve 35, via the pressure in a control chamber 34. In the first switching position shown in FIG. 4, a pressure relief of the control chamber 34 is prevented by a valve ball 36. Via an inlet throttle 29 embodied in the first control piston 21, fuel subjected to high pressure reaches the control chamber 34. The fuel subjected to high pressure that is located in the control chamber 34 assures that the first control piston 21 is pressed downward, counter to the second control piston 22. As a result, the first valve seat 24 is kept closed. At the same time, the second control piston 22 is pressed against the compression spring 23.

When the magnet valve 35 opens and the valve ball 36 lifts from its associated seat, the pressure in the control chamber 34 drops, and the first control piston 21 moves upward as far as a stop 28. The speed of the motion of the first control piston 21 can be adjusted by means of the design of the surfaces subjected to pressure on the first control piston 21 and by the adaptation of an inlet throttle 29 and an outlet throttle 31.

At the same time, the second control piston 22 is likewise moved upward by the prestressing force of the compression spring 23, so that the second valve seat 30 is closed.

All the valve faces that are in direct communication with the connection 27 are designed such that they cannot exert any forces on the control pistons 21 and 22. The forces acting on the control pistons 21 and 22 derive either from the compression spring 23 or are hydraulic forces, which during the phase of motion of the first control piston 21 and the second control piston 22 exhibit no sudden changes in force or other irregularities whatever.

The production of the metering valve 8 is thus simplified, and the operating performance of the engine is improved.

The two control pistons 21 and 22 are guided separately. This simplifies the production of the metering valve considerably. Moreover, any error of alignment of the second control piston 22 to the first control piston 21 has no adverse effect on the function of the metering valve 8. The size of the metering and diversion cross section can be made arbitrarily large. The pressure-balanced control pistons 21 and 22 lead to reduced wear. The speeds of motion of the two control pistons 21 and 22 during operation are identical. This means that by means of the design of the inlet throttle and the outlet throttle, the speed of the opening phase and the speed of the closing phase can be varied.

In the currentless state of the magnet valve 35, the first control piston 21 is held in its lower position. As a result, the communication with the fuel inlet 26 and thus also with the common rail (not shown) remains closed, and the communication between the fuel return 32 and the connection 27 remains open. In the switching position shown in FIG. 4, no injection takes place.

When current is supplied to the magnet valve 35, the pressure in the control chamber 34 drops, and the pressure forces acting on the control piston 21 lift it out of the first valve seat 24. Simultaneously, the compression spring 23 assures lifting of the second control piston 22. The communication between the fuel inlet 26 and the connection 27 is now opened. At the same time, the communication between the connection 27 and the fuel return 32 is interrupted.

When the current supply to the magnet valve 35 is interrupted, the pressure in the control chamber 34 rises again, and the first control piston 21 is again pressed downward into the first valve seat 24. Simultaneously, as a result of the downward motion of the first control piston 21, the second control piston 22 is also pressed downward, counter to the compression spring 23. This interrupts the communication between the fuel inlet 26 and the connection 27. Moreover, the communication between the connection 27 and the first fuel return 32 is opened.

The foregoing relates to preferred exemplary embodiment of the invention, it being understood that other variants and embodiments thereof are possible within the spirit and scope of the invention, the latter being defined by the appended claims.

What is claimed is:

1. A 3/2-way valve for controlling the injection of fuel in a common rail injection system of an internal combustion engine, comprising a control member guided in a housing (20), wherein the control member in a first switching position opens a hydraulic communication between an injector (7) and a fuel return (42), and in a second switching position the control member opens a hydraulic communication between the injector (7) and an inlet (26) from a common rail (3), the control member including a first control piston (21) and a second control piston (22);

a first valve seat (24) between the housing (20) and the first control piston (21) and a second valve seat between the housing (20) and the second control piston (22).

2. The 3/2-way valve of claim 1, wherein one face end (39) of the first control piston (21) defines a control chamber (34); wherein the control chamber (34) is in hydraulic communication with the fuel inlet (26) via an inlet throttle (32); and wherein the control chamber (34) can be made to communicate hydraulically with an outlet via an outlet throttle (31).

3. The 3/2-way valve of claim 2, wherein the hydraulic communication between the control chamber (34) and the outlet is controlled by a magnet valve (35) or a piezoelectric actuator.

4. The 3/2-way valve of claim 2, wherein the inlet throttle (29) is integrated with the first control piston (21).

5. The 3/2-way valve of claim 3, wherein the inlet throttle (29) is integrated with the first control piston (21).

6. The 3/2-way valve of claim 1, wherein one face end (25) of the second control piston (22) defines a pressure chamber (37); and wherein, in the pressure chamber (37), the pressure of the common rail (3) prevails.

7. The 3/2-way valve of claim 2, wherein one face end (25) of the second control piston (22) defines a pressure chamber (37); and wherein, in the pressure chamber (37), the pressure of the common rail (3) prevails.

8. The 3/2-way valve of claim 4, wherein one face end (25) of the second control piston (22) defines a pressure chamber (37); and wherein, in the pressure chamber (37), the pressure of the common rail (3) prevails.

9. The 3/2-way valve of claim 1, wherein the face end (25) of the second control piston (22) is subjected to the prestressing force of a compression spring (23).

10. The 3/2-way valve of claim 2, wherein the face end (25) of the second control piston (22) is subjected to the prestressing force of a compression spring (23).

11. The 3/2-way valve of claim 4, wherein the face end (25) of the second control piston (22) is subjected to the prestressing force of a compression spring (23).

12. The 3/2-way valve of claim 6, wherein the face end (25) of the second control piston (22) is subjected to the prestressing force of a compression spring (23).

13. The 3/2-way valve of claim 1, wherein the first control piston (21) is guided in a guide bore (39); wherein the connection (27) discharges into the guide bore (39); and wherein the first control piston (21) has a first plunge cut (40) in the region of the orifice (27*a*) of the connection (27).

14. The 3/2-way valve of claim wherein the first control piston (21) is guided in a guide bore (39); wherein the connection (27) discharges into the guide bore (39); and wherein the first control piston (21) has a first plunge cut (40) in the region of the orifice (27*a*) of the connection (27).

15. The 3/2-way valve of claim 4, wherein the first control piston (21) is guided in a guide bore (39); wherein the connection (27) discharges into the guide bore (39); and wherein the first control piston (21) has a first plunge cut (40) in the region of the orifice (27*a*) of the connection (27).

16. The 3/2-way valve of claim 6, wherein the first control piston (21) is guided in a guide bore (39); wherein the connection (27) discharges into the guide bore (39); and wherein the first control piston (21) has a first plunge cut (40) in the region of the orifice (27*a*) of the connection (27).

17. The 3/2-way valve of claim 9, wherein the first control piston (21) is guided in a guide bore (39); wherein the connection (27) discharges into the guide bore (39); and wherein the first control piston (21) has a first plunge cut (40) in the region of the orifice (27*a*) of the connection (27).

18. The 3/2-way valve of claim 13, wherein the second control piston (22) is guided in a guide bore (39); wherein the connection (27) discharges into the guide bore (39); and wherein the second control piston (22) has a second plunge cut (41) in the region of the orifice (27*b*) of the connection (27).

19. The 3/2-way valve of claim 1, used in conjunction with an injector (7), a unit fuel injector, or an injection nozzle.

* * * * *